US007175179B2

(12) United States Patent
Marks et al.

(10) Patent No.: US 7,175,179 B2
(45) Date of Patent: Feb. 13, 2007

(54) METHOD OF PLAYING A TWENTY-ONE GAME USING UNKNOWN SHARED CARDS ("SUSPENSE 21")

(76) Inventors: Howard M. Marks, 209 Garth Rd., Apt. 6A, Scarsdale, NY (US) 10583; Michael Wood, 1951 Florida Ave. SW. - Ste. B, Denham Spings, LA (US) 70726; Daniel M. Marks, 114 6th St. SE., Washington, DC (US) 20003; Anthony M. Singer, 125 Burnt Meadow, Ringwood, NJ (US) 07456

( * ) Notice: Subject to any disclaimer, the term of this patent is extended or adjusted under 35 U.S.C. 154(b) by 387 days.

(21) Appl. No.: 10/773,209

(22) Filed: Feb. 9, 2004

(65) Prior Publication Data

US 2004/0155405 A1 Aug. 12, 2004

Related U.S. Application Data

(60) Provisional application No. 60/445,769, filed on Feb. 10, 2003.

(51) Int. Cl.
*A63F 1/00* (2006.01)

(52) U.S. Cl. ..... 273/292; 273/274

(58) Field of Classification Search ..... 273/292, 273/274, 309; 463/12

See application file for complete search history.

(56) References Cited

U.S. PATENT DOCUMENTS

| | | | | |
|---|---|---|---|---|
| 5,320,356 | A * | 6/1994 | Cauda | 273/292 |
| 5,549,300 | A * | 8/1996 | Sardarian | 273/292 |
| 5,934,675 | A * | 8/1999 | Handelman et al. | 273/292 |
| 6,311,978 | B1 * | 11/2001 | Moody | 273/292 |
| 6,655,690 | B1 * | 12/2003 | Oskwarek | 273/292 |
| 6,808,173 | B2 * | 10/2004 | Snow | 273/292 |

* cited by examiner

*Primary Examiner*—Benjamin Layno

(57) ABSTRACT

The present invention is a variant of traditional Twenty-One in which the dealer and players attempt to build a hand with a value of twenty-one, or as close to twenty-one as possible without exceeding twenty-one, using cards that are known to players and the dealer as they are dealt and shared cards that remain unknown until all player and/or dealer decisions are completed.

43 Claims, 11 Drawing Sheets

Suspense 21

| Basic Strategy for Multi Deck Suspense 21 | | | | | | | | | | | | | |
|---|---|---|---|---|---|---|---|---|---|---|---|---|---|
| | Your Hand | Dealer's card | | | | | | | | | | Your Hand | |
| | | 2 | 3 | 4 | 5 | 6 | 7 | 8 | 9 | 10 | A | | |
| | 2 | H | H | H | H | H | H | R | S | R | H | 2 | |
| | 3 | H | H | H | H | H | H | H | S | R | H | 3 | |
| | 4 | H | H | H | H | H | H | S | S | H | H | 4 | |
| | 5 | H | H | H | H | H | H | S | S | H | H | 5 | |
| | 6 | H | H | H | H | H | S | S | S | H | H | 6 | |
| | 7 | H | H | S | S | S | S | S | S | H | H | 7 | |
| | 8 | H | S | S | S | S | S | S | H | H | H | 8 | |
| | 9 | S | S | S | S | S | S | S | S | H | H | 9 | |
| | 10 | S | S | S | S | S | S | S | S | S | H | 10 | |
| | hard 11+ | S | S | S | S | S | S | S | S | S | S | hard 11+ | |
| | A | S | R | R | R | R | R | R | S | S | S | A | |
| A+A | soft 12 | S | S | S | S | S | R | R | S | S | S | soft 12 | A+A |
| A+2 | soft 13 | S | S | S | S | S | S | S | S | S | S | soft 13 | A+2 |
| A+3 | soft 14 | S | S | S | S | S | S | S | S | H | S | soft 14 | A+3 |
| A+4 | soft 15 | S | S | S | S | S | S | S | S | H | S | soft 15 | A+4 |
| A+5 | soft 16 | S | S | S | S | S | S | S | S | H | H | soft 16 | A+5 |
| A+6 | soft 17 | S | S | S | S | S | S | S | S | H | H | soft 17 | A+6 |
| A+7 | soft 18 | S | S | S | S | S | S | S | H | H | H | soft 18 | A+7 |
| A+8 | soft 19 | S | S | S | S | S | S | S | S | H | H | soft 19 | A+8 |
| A+9 | soft 20 | S | S | S | S | S | S | S | S | S | H | soft 20 | A+9 |
| A+10 | soft 21 | S | S | S | S | S | S | S | S | S | S | soft 21 | A+10 |
| | | 2 | 3 | 4 | 5 | 6 | 7 | 8 | 9 | 10 | A | | |
| | | Dealer's card | | | | | | | | | | | |

| | |
|---|---|
| S | = Stay |
| H | = Hit |
| R | = Raise & Hit |

| Wagering and Game-Play Options |
|---|
| 1) 6 decks of cards |
| 2) Bet doubling allowed (1,2,4,8,etc) |
| 3) Raise bet anytime is allowed |
| 4) Multiple hits allowed after raising bet |
| 5) Blackjack pays 3:2 odds |
| 6) Blackjack beats all other twenty-one hand counts |
| 7) Dealer and Player blackjacks push |
| Note: Strategy card will maximize player's net profits. |

| Strategy Summary Stats | |
|---|---|
| Player's Profit | -0.018 |
| Average Bet | 1.0899 |
| Game Return | 98.3506% |
| House % of Bet | 1.6494% |

FIGURE 2

D6-R1-C1-H1A 1) 6 Decks of cards
2) Raise bets by 1 unit only (1 to 2)
3) Raise on first (1st) card only
4) Only 1 hit after raising bet

Suspense 21

| Regular BlackJack Game | | |
|---|---|---|
| Totals | Dealer | Player |
| 4 | | 0.000274 |
| 5 | | 0.000571 |
| 6 | | 0.000845 |
| 7 | | 0.001142 |
| 8 | | 0.001416 |
| 9 | | 0.001713 |
| 10 | | 0.001987 |
| 11 | | 0.003167 |
| 12 | | 0.030802 |
| 13 | | 0.052658 |
| 14 | | 0.046907 |
| 15 | | 0.047534 |
| 16 | | 0.047534 |
| 17 | 0.145225 | 0.115280 |
| 18 | 0.139247 | 0.109544 |
| 19 | 0.133685 | 0.115720 |
| 20 | 0.179583 | 0.160582 |
| 21 | 0.120338 | 0.102194 |
| Bust | 0.281922 | 0.152956 |
| Return | | 0.9965 |

| Suspense 21 Game | | |
|---|---|---|
| Totals | Dealer | Player |
| 6 | | 0.00052 |
| 7 | | 0.00112 |
| 8 | | 0.00234 |
| 9 | | 0.00543 |
| 10 | | 0.00929 |
| 11 | 0.00306 | 0.01391 |
| 12 | 0.04464 | 0.04875 |
| 13 | 0.05178 | 0.05539 |
| 14 | 0.05685 | 0.06104 |
| 15 | 0.06173 | 0.06558 |
| 16 | 0.06620 | 0.07059 |
| 17 | 0.07033 | 0.07896 |
| 18 | 0.07396 | 0.08213 |
| 19 | 0.08653 | 0.08347 |
| 20 | 0.15987 | 0.13528 |
| 21 | 0.10447 | 0.08616 |
| Bust | 0.22058 | 0.20005 |
| Return | | 0.980498 |

| Regular BJ | Suspense 21 |
|---|---|
| Player Exp. Profit -0.0040 | Player Exp. Profit -0.02020 |
| Standard Deviation 1.135003 | Standard Deviation 0.984865 |
| Expected Wager 1.1318 | Expected Wager 1.035600 |
| Player Wins 0.4346 | Player Wins 0.377008 |
| Player Loses 0.4798 | Player Loses 0.439676 |
| Player Pushes 0.0856 | Player Pushes 0.159494 |
| Player Cards 2.7113 | Player Cards 1.5925 |
| Player BJ win 0.0454 | Player BJ win 0.0202 |

| Decks | Cut Cards | Playable | Wager |
|---|---|---|---|
| 6 | 78 | 234 | $5 |

| Expected Number of Rounds/Shoe | | |
|---|---|---|
| Players | Regular BJ | Suspense 21 |
| 3 | 28.77 | 48.98 |
| 4 | 21.58 | 36.73 |
| 5 | 17.26 | 29.39 |
| 6 | 14.38 | 24.49 |
| 7 | 12.33 | 20.99 |

| $ Won by House per Shoe | |
|---|---|
| Reg BJ | Suspense |
| Win / Shoe | Win / Shoe |
| $ 1.71 | $ 14.33 |

| Cards removed | z | PFavoribility | Odds |
|---|---|---|---|
| 52 | 3.6133 | 0.000151192 | 6614.10 |
| 104 | 2.5165 | 0.005926811 | 168.72 |
| 156 | 2.0232 | 0.021524252 | 46.46 |
| 208 | 1.7249 | 0.042269542 | 23.66 |
| 226 | 1.6458 | 0.049905342 | 20.04 |

FIGURE 3A

Suspense 21

D6-R1-C1-MHA 1) 6 Decks of cards
2) Raise bets by 1 unit only (1 to 2)
3) Raise on first (1st) card only
4) Multiple hits allowed after raising bet

| Regular BlackJack Game | | |
|---|---|---|
| Totals | Dealer | Player |
| 4 | | 0.000274 |
| 5 | | 0.000571 |
| 6 | | 0.000845 |
| 7 | | 0.001142 |
| 8 | | 0.001416 |
| 9 | | 0.001713 |
| 10 | | 0.001987 |
| 11 | | 0.003167 |
| 12 | | 0.030802 |
| 13 | | 0.052658 |
| 14 | | 0.046907 |
| 15 | | 0.047534 |
| 16 | | 0.047534 |
| 17 | 0.145225 | 0.115280 |
| 18 | 0.139247 | 0.109544 |
| 19 | 0.133685 | 0.115720 |
| 20 | 0.179583 | 0.160582 |
| 21 | 0.120338 | 0.102194 |
| Bust | 0.281922 | 0.152956 |
| Return | | 0.9965 |

| Suspense 21 Game | | |
|---|---|---|
| Totals | Dealer | Player |
| | | |
| | | |
| 6 | | 0.00052 |
| 7 | | 0.00112 |
| 8 | | 0.00233 |
| 9 | | 0.00543 |
| 10 | | 0.00928 |
| 11 | 0.00306 | 0.01391 |
| 12 | 0.04464 | 0.04887 |
| 13 | 0.05178 | 0.05549 |
| 14 | 0.05685 | 0.06116 |
| 15 | 0.06173 | 0.06568 |
| 16 | 0.06620 | 0.07070 |
| 17 | 0.07033 | 0.07906 |
| 18 | 0.07396 | 0.08225 |
| 19 | 0.08653 | 0.08357 |
| 20 | 0.15987 | 0.13539 |
| 21 | 0.10447 | 0.08518 |
| Bust | 0.22058 | 0.20004 |
| Return | | 0.983457 |

| Regular BJ | Suspense 21 |
|---|---|
| Player Exp. Profit -0.0040 | Player Exp. Profit -0.01800 |
| Standard Deviation 1.135003 | Standard Deviation 1.053903 |
| Expected Wager 1.1321 | Expected Wager 1.089000 |
| Player Wins 0.4346 | Player Wins 0.378858 |
| Player Loses 0.4798 | Player Loses 0.439601 |
| Player Pushes 0.0856 | Player Pushes 0.159557 |
| Player Cards 2.7119 | Player Cards 1.5984 |
| Player BJ win 0.0454 | Player BJ win 0.0202 |

| Decks | Cut Cards | Playable | Wager |
|---|---|---|---|
| 6 | 78 | 234 | $5 |

| Expected Number of Rounds/Shoe | | |
|---|---|---|
| Players | Regular BJ | Suspense 21 |
| 3 | 28.76 | 48.80 |
| 4 | 21.57 | 36.60 |
| 5 | 17.26 | 29.28 |
| 6 | 14.38 | 24.40 |
| 7 | 12.33 | 20.91 |

| $ Won by House per Shoe | |
|---|---|
| Reg BJ | Suspense |
| Win / Shoe | Win / Shoe |
| $ 1.71 | $ 12.11 |

| Cards removed | z | PFavoribility | Odds |
|---|---|---|---|
| 52 | 3.4548 | 0.000275383 | 3631.31 |
| 104 | 2.3657 | 0.008997816 | 111.14 |
| 156 | 1.8685 | 0.030842958 | 32.422 |
| 208 | 1.5636 | 0.058954793 | 16.962 |
| 226 | 1.4819 | 0.069181178 | 14.455 |

FIGURE 3B

D6-R1-AC-MHA 1) 6 Decks of cards
2) Raise bets by 1 unit only (1,2,3,4, etc.)
3) Raise bet anytime is allowed
4) Multiple hits allowed after raising bet.

Suspense 21

| Regular BlackJack Game | | |
|---|---|---|
| Totals | Dealer | Player |
| 4 | | 0.000274 |
| 5 | | 0.000571 |
| 6 | | 0.000845 |
| 7 | | 0.001142 |
| 8 | | 0.001416 |
| 9 | | 0.001713 |
| 10 | | 0.001987 |
| 11 | | 0.003167 |
| 12 | | 0.030802 |
| 13 | | 0.052658 |
| 14 | | 0.046907 |
| 15 | | 0.047534 |
| 16 | | 0.047534 |
| 17 | 0.145225 | 0.115280 |
| 18 | 0.139247 | 0.109544 |
| 19 | 0.133685 | 0.115720 |
| 20 | 0.179583 | 0.160582 |
| 21 | 0.120338 | 0.102194 |
| Bust | 0.281922 | 0.152956 |
| Return | | 0.9965 |

| Suspense 21 Game | | |
|---|---|---|
| Totals | Dealer | Player |
| | | |
| 6 | | 0.00052 |
| 7 | | 0.00112 |
| 8 | | 0.00233 |
| 9 | | 0.00543 |
| 10 | | 0.00928 |
| 11 | 0.00306 | 0.01391 |
| 12 | 0.04464 | 0.04887 |
| 13 | 0.05178 | 0.05549 |
| 14 | 0.05685 | 0.06116 |
| 15 | 0.06173 | 0.06568 |
| 16 | 0.06620 | 0.07070 |
| 17 | 0.07033 | 0.07906 |
| 18 | 0.07396 | 0.08225 |
| 19 | 0.08653 | 0.08357 |
| 20 | 0.15987 | 0.13539 |
| 21 | 0.10447 | 0.08518 |
| Bust | 0.22058 | 0.20004 |
| Return | | 0.983457 |

| Regular BJ | Suspense 21 |
|---|---|
| Player Exp. Profit -0.0040 | Player Exp. Profit -0.01800 |
| Standard Deviation 1.135003 | Standard Deviation 1.053903 |
| Expected Wager 1.1321 | Expected Wager 1.089000 |
| Player Wins 0.4346 | Player Wins 0.378858 |
| Player Loses 0.4798 | Player Loses 0.439601 |
| Player Pushes 0.0856 | Player Pushes 0.159557 |
| Player Cards 2.7119 | Player Cards 1.5984 |
| Player BJ win 0.0454 | Player BJ win 0.0202 |

| Decks | Cut Cards | Playable | Wager |
|---|---|---|---|
| 6 | 78 | 234 | $5 |

| Expected Number of Rounds/Shoe | | |
|---|---|---|
| Players | Regular BJ | Suspense 21 |
| 3 | 28.76 | 48.80 |
| 4 | 21.57 | 36.60 |
| 5 | 17.26 | 29.28 |
| 6 | 14.38 | 24.40 |
| 7 | 12.33 | 20.91 |

| $ Won by House per Shoe | |
|---|---|
| Reg BJ | Suspense |
| Win / Shoe | Win / Shoe |
| $ 1.71 | $ 12.11 |

| Cards removed | z | PFavoribility | Odds |
|---|---|---|---|
| 52 | 3.4548 | 0.000275383 | 3631.31 |
| 104 | 2.3657 | 0.008997816 | 111.14 |
| 156 | 1.8685 | 0.030842958 | 32.42 |
| 208 | 1.5636 | 0.058954793 | 16.96 |
| 226 | 1.4819 | 0.069181178 | 14.45 |

FIGURE 3C

D6-RD-C1-H1A 1) 6 Decks of cards
2) Bet Doubling Allowed (1,2,4,8, etc.)
3) Raise on first (1st) card only
4) Only 1 hit after raising bet

Suspense 21

| Regular BlackJack Game | | |
|---|---|---|
| Totals | Dealer | Player |
| 4 | | 0.000274 |
| 5 | | 0.000571 |
| 6 | | 0.000845 |
| 7 | | 0.001142 |
| 8 | | 0.001416 |
| 9 | | 0.001713 |
| 10 | | 0.001987 |
| 11 | | 0.003167 |
| 12 | | 0.030802 |
| 13 | | 0.052658 |
| 14 | | 0.046907 |
| 15 | | 0.047534 |
| 16 | | 0.047534 |
| 17 | 0.145225 | 0.115280 |
| 18 | 0.139247 | 0.109544 |
| 19 | 0.133685 | 0.115720 |
| 20 | 0.179583 | 0.160582 |
| 21 | 0.120338 | 0.102194 |
| Bust | 0.281922 | 0.152956 |
| Return | | 0.9965 |

| Suspense 21 Game | | |
|---|---|---|
| Totals | Dealer | Player |
| 6 | | 0.00052 |
| 7 | | 0.00112 |
| 8 | | 0.00234 |
| 9 | | 0.00543 |
| 10 | | 0.00929 |
| 11 | 0.00306 | 0.01391 |
| 12 | 0.04464 | 0.04875 |
| 13 | 0.05178 | 0.05539 |
| 14 | 0.05685 | 0.06104 |
| 15 | 0.06173 | 0.06558 |
| 16 | 0.06620 | 0.07059 |
| 17 | 0.07033 | 0.07896 |
| 18 | 0.07396 | 0.08213 |
| 19 | 0.08653 | 0.08347 |
| 20 | 0.15987 | 0.13528 |
| 21 | 0.10447 | 0.08616 |
| Bust | 0.22058 | 0.20005 |
| Return | | 0.980498 |

| Regular BJ | Suspense 21 |
|---|---|
| Player Exp. Profit -0.0040 | Player Exp. Profit -0.02020 |
| Standard Deviation 1.135003 | Standard Deviation 0.984865 |
| Expected Wager 1.1321 | Expected Wager 1.035600 |
| Player Wins 0.4346 | Player Wins 0.377008 |
| Player Loses 0.4798 | Player Loses 0.439676 |
| Player Pushes 0.0856 | Player Pushes 0.159494 |
| Player Cards 2.7119 | Player Cards 1.5925 |
| Player BJ win 0.0454 | Player BJ win 0.0202 |

| Decks | Cut Cards | Playable | Wager |
|---|---|---|---|
| 6 | 78 | 234 | $5 |

| Expected Number of Rounds/Shoe | | |
|---|---|---|
| Players | Regular BJ | Suspense 21 |
| 3 | 28.76 | 48.98 |
| 4 | 21.57 | 36.73 |
| 5 | 17.26 | 29.39 |
| 6 | 14.38 | 24.49 |
| 7 | 12.33 | 20.99 |

| $ Won by House per Shoe | |
|---|---|
| Reg BJ | Suspense |
| Win / Shoe | Win / Shoe |
| $ 1.71 | $ 14.33 |

| Cards removed | z | PFavoribility | Odds |
|---|---|---|---|
| 52 | 3.6133 | 0.000151192 | 6614.10 |
| 104 | 2.5165 | 0.005926811 | 168.72 |
| 156 | 2.0232 | 0.021524252 | 46.46 |
| 208 | 1.7249 | 0.042269542 | 23.66 |
| 226 | 1.6458 | 0.049905342 | 20.04 |

FIGURE 3D

Suspense 21

D6-RD-C1-MHA 1) 6 Decks of cards
2) Bet Doubling Allowed (1,2,4,8, etc.)
3) Raise on first (1st) card only
4) Multiple hits allowed after raising bet

| Regular BlackJack Game | | |
|---|---|---|
| Totals | Dealer | Player |
| 4 | | 0.000274 |
| 5 | | 0.000571 |
| 6 | | 0.000845 |
| 7 | | 0.001142 |
| 8 | | 0.001416 |
| 9 | | 0.001713 |
| 10 | | 0.001987 |
| 11 | | 0.003167 |
| 12 | | 0.030802 |
| 13 | | 0.052658 |
| 14 | | 0.046907 |
| 15 | | 0.047534 |
| 16 | | 0.047534 |
| 17 | 0.145225 | 0.115280 |
| 18 | 0.139247 | 0.109544 |
| 19 | 0.133685 | 0.115720 |
| 20 | 0.179583 | 0.160582 |
| 21 | 0.120338 | 0.102194 |
| Bust | 0.281922 | 0.152956 |
| Return | | 0.9965 |

| Suspense 21 Game | | |
|---|---|---|
| Totals | Dealer | Player |
| | | |
| | | |
| 6 | | 0.00052 |
| 7 | | 0.00112 |
| 8 | | 0.00233 |
| 9 | | 0.00543 |
| 10 | | 0.00928 |
| 11 | 0.00306 | 0.01391 |
| 12 | 0.04464 | 0.04887 |
| 13 | 0.05178 | 0.05549 |
| 14 | 0.05685 | 0.06116 |
| 15 | 0.06173 | 0.06568 |
| 16 | 0.06620 | 0.07070 |
| 17 | 0.07033 | 0.07906 |
| 18 | 0.07396 | 0.08225 |
| 19 | 0.08653 | 0.08357 |
| 20 | 0.15987 | 0.13539 |
| 21 | 0.10447 | 0.08518 |
| Bust | 0.22058 | 0.20004 |
| Return | | 0.983457 |

| Regular BJ | Suspense 21 |
|---|---|
| Player Exp. Profit -0.0040 | Player Exp. Profit -0.01800 |
| Standard Deviation 1.135003 | Standard Deviation 1.053903 |
| Expected Wager 1.1321 | Expected Wager 1.089000 |
| Player Wins 0.4346 | Player Wins 0.378858 |
| Player Loses 0.4798 | Player Loses 0.439601 |
| Player Pushes 0.0856 | Player Pushes 0.159557 |
| Player Cards 2.7119 | Player Cards 1.5984 |
| Player BJ win 0.0454 | Player BJ win 0.0202 |

| Decks | Cut Cards | Playable | Wager |
|---|---|---|---|
| 6 | 78 | 234 | $5 |

| Expected Number of Rounds/Shoe | | |
|---|---|---|
| Players | Regular BJ | Suspense 21 |
| 3 | 28.76 | 48.80 |
| 4 | 21.57 | 36.60 |
| 5 | 17.26 | 29.28 |
| 6 | 14.38 | 24.40 |
| 7 | 12.33 | 20.91 |

| $ Won by House per Shoe | |
|---|---|
| Reg BJ | Suspense |
| Win / Shoe | Win / Shoe |
| $ 1.71 | $ 12.11 |

| Cards removed | z | PFavoribility | Odds |
|---|---|---|---|
| 52 | 3.4548 | 0.000275383 | 3631.31 |
| 104 | 2.3657 | 0.008997816 | 111.14 |
| 156 | 1.8685 | 0.030842958 | 32.422 |
| 208 | 1.5636 | 0.058954793 | 16.962 |
| 226 | 1.4819 | 0.069181178 | 14.455 |

FIGURE 3E

D6-RD-AC-MHA 1) 6 Decks of cards
2) Bet Doubling Allowed (1,2,4,8, etc.)
3) Raise bet anytime is allowed
4) Multiple hits allowed after raising bet

Suspense 21

| Regular BlackJack Game | | |
|---|---|---|
| Totals | Dealer | Player |
| 4 | | 0.000274 |
| 5 | | 0.000571 |
| 6 | | 0.000845 |
| 7 | | 0.001142 |
| 8 | | 0.001416 |
| 9 | | 0.001713 |
| 10 | | 0.001987 |
| 11 | | 0.003167 |
| 12 | | 0.030802 |
| 13 | | 0.052658 |
| 14 | | 0.046907 |
| 15 | | 0.047534 |
| 16 | | 0.047534 |
| 17 | 0.145225 | 0.115280 |
| 18 | 0.139247 | 0.109544 |
| 19 | 0.133685 | 0.115720 |
| 20 | 0.179583 | 0.160582 |
| 21 | 0.120338 | 0.102194 |
| Bust | 0.281922 | 0.152956 |
| Return | | 0.9965 |

| Suspense 21 Game | | |
|---|---|---|
| Totals | Dealer | Player |
| | | |
| 6 | | 0.00052 |
| 7 | | 0.00112 |
| 8 | | 0.00233 |
| 9 | | 0.00543 |
| 10 | | 0.00928 |
| 11 | 0.00306 | 0.01391 |
| 12 | 0.04464 | 0.04864 |
| 13 | 0.05178 | 0.05551 |
| 14 | 0.05685 | 0.06118 |
| 15 | 0.06173 | 0.06569 |
| 16 | 0.06620 | 0.07072 |
| 17 | 0.07033 | 0.07908 |
| 18 | 0.07396 | 0.08226 |
| 19 | 0.08653 | 0.08358 |
| 20 | 0.15987 | 0.13541 |
| 21 | 0.10447 | 0.08519 |
| Bust | 0.22058 | 0.20013 |
| Return | | 0.983506 |

| Regular BJ | Suspense 21 |
|---|---|
| Player Exp. Profit -0.0040 | Player Exp. Profit -0.01800 |
| Standard Deviation 1.135003 | Standard Deviation 1.058624 |
| Expected Wager 1.1321 | Expected Wager 1.089900 |
| Player Wins 0.4346 | Player Wins 0.378808 |
| Player Loses 0.4798 | Player Loses 0.439649 |
| Player Pushes 0.0856 | Player Pushes 0.159559 |
| Player Cards 2.7119 | Player Cards 1.5993 |
| Player BJ win 0.0454 | Player BJ win 0.0202 |

| Decks | Cut Cards | Playable | Wager |
|---|---|---|---|
| 6 | 78 | 234 | $5 |

| Expected Number of Rounds/Shoe | | |
|---|---|---|
| Players | Regular BJ | Suspense 21 |
| 3 | 28.76 | 48.77 |
| 4 | 21.57 | 36.58 |
| 5 | 17.26 | 29.26 |
| 6 | 14.38 | 24.39 |
| 7 | 12.33 | 20.90 |

| $ Won by House per Shoe | |
|---|---|
| Reg BJ | Suspense |
| Win / Shoe | Win / Shoe |
| $ 1.71 | $ 12.07 |

| Cards removed | z | PFavoribility | Odds |
|---|---|---|---|
| 52 | 3.4459 | 0.000284642 | 3513.19 |
| 104 | 2.3600 | 0.009137478 | 109.44 |
| 156 | 1.8644 | 0.031134256 | 32.119 |
| 208 | 1.5604 | 0.059329611 | 16.855 |
| 226 | 1.4790 | 0.069569343 | 14.374 |

FIGURE 3F

D6-RT-C1-H1A 1) 6 Decks of cards
2) Bet Tripling Allowed (1 to 3)
3) Raise on first (1st) card only
4) Only 1 hit after raising bet

Suspense 21

| Regular BlackJack Game | | |
|---|---|---|
| Totals | Dealer | Player |
| 4 | | 0.000274 |
| 5 | | 0.000571 |
| 6 | | 0.000845 |
| 7 | | 0.001142 |
| 8 | | 0.001416 |
| 9 | | 0.001713 |
| 10 | | 0.001987 |
| 11 | | 0.003167 |
| 12 | | 0.030802 |
| 13 | | 0.052658 |
| 14 | | 0.046907 |
| 15 | | 0.047534 |
| 16 | | 0.047534 |
| 17 | 0.145225 | 0.115280 |
| 18 | 0.139247 | 0.109544 |
| 19 | 0.133685 | 0.115720 |
| 20 | 0.179583 | 0.160582 |
| 21 | 0.120338 | 0.102194 |
| Bust | 0.281922 | 0.152956 |
| Return | | 0.9965 |

| Suspense 21 Game | | |
|---|---|---|
| Totals | Dealer | Player |
| | | |
| | | |
| 6 | | 0.00052 |
| 7 | | 0.00112 |
| 8 | | 0.00234 |
| 9 | | 0.00543 |
| 10 | | 0.00929 |
| 11 | 0.00306 | 0.01391 |
| 12 | 0.04464 | 0.04898 |
| 13 | 0.05178 | 0.05561 |
| 14 | 0.05685 | 0.06125 |
| 15 | 0.06173 | 0.06579 |
| 16 | 0.06620 | 0.07080 |
| 17 | 0.07033 | 0.07917 |
| 18 | 0.07396 | 0.08234 |
| 19 | 0.08653 | 0.08368 |
| 20 | 0.15987 | 0.13549 |
| 21 | 0.10447 | 0.08425 |
| Bust | 0.22058 | 0.20005 |
| Return | | 0.988630 |

| Regular BJ | Suspense 21 |
|---|---|
| Player Exp. Profit -0.0040 | Player Exp. Profit -0.01190 |
| Standard Deviation 1.135003 | Standard Deviation 1.104352 |
| Expected Wager 1.1321 | Expected Wager 1.047500 |
| Player Wins 0.4346 | Player Wins 0.380722 |
| Player Loses 0.4798 | Player Loses 0.439541 |
| Player Pushes 0.0856 | Player Pushes 0.159592 |
| Player Cards 2.7119 | Player Cards 1.6043 |
| Player BJ win 0.0454 | Player BJ win 0.0202 |

| Decks | Cut Cards | Playable | Wager |
|---|---|---|---|
| 6 | 78 | 234 | $5 |

| Expected Number of Rounds/Shoe | | |
|---|---|---|
| Players | Regular BJ | Suspense 21 |
| 3 | 28.76 | 48.62 |
| 4 | 21.57 | 36.46 |
| 5 | 17.26 | 29.17 |
| 6 | 14.38 | 24.31 |
| 7 | 12.33 | 20.84 |

| $ Won by House per Shoe | |
|---|---|
| Reg BJ | Suspense |
| Win / Shoe | Win / Shoe |
| $ 1.71 | $ 8.29 |

| Cards removed | z | PFavoribility | Odds |
|---|---|---|---|
| 52 | 1.9784 | 0.023942137 | 41.77 |
| 104 | 1.3893 | 0.082365714 | 12.14 |
| 156 | 1.1265 | 0.129967134 | 7.69 |
| 208 | 0.9688 | 0.166315267 | 6.01 |
| 226 | 0.9272 | 0.176913336 | 5.65 |

FIGURE 3G

Suspense 21

D6-RT-C1-MHA 1) 6 Decks of cards
2) Bet Tripling Allowed (1 to 3)
3) Raise on first (1st) card only
4) Multiple hits allowed after raising bet

| Regular BlackJack Game | | |
|---|---|---|
| Totals | Dealer | Player |
| 4 | | 0.000274 |
| 5 | | 0.000571 |
| 6 | | 0.000845 |
| 7 | | 0.001142 |
| 8 | | 0.001416 |
| 9 | | 0.001713 |
| 10 | | 0.001987 |
| 11 | | 0.003167 |
| 12 | | 0.030802 |
| 13 | | 0.052658 |
| 14 | | 0.046907 |
| 15 | | 0.047534 |
| 16 | | 0.047534 |
| 17 | 0.145225 | 0.115280 |
| 18 | 0.139247 | 0.109544 |
| 19 | 0.133685 | 0.115720 |
| 20 | 0.179583 | 0.160582 |
| 21 | 0.120338 | 0.102194 |
| Bust | 0.281922 | 0.152956 |
| Return | | 0.9965 |

| Suspense 21 Game | | |
|---|---|---|
| Totals | Dealer | Player |
| | | |
| | | |
| 6 | | 0.00052 |
| 7 | | 0.00112 |
| 8 | | 0.00233 |
| 9 | | 0.00543 |
| 10 | | 0.00928 |
| 11 | 0.00306 | 0.01391 |
| 12 | 0.04464 | 0.04899 |
| 13 | 0.05178 | 0.05560 |
| 14 | 0.05685 | 0.06127 |
| 15 | 0.06173 | 0.06578 |
| 16 | 0.06620 | 0.07081 |
| 17 | 0.07033 | 0.07916 |
| 18 | 0.07396 | 0.08235 |
| 19 | 0.08653 | 0.08367 |
| 20 | 0.15987 | 0.13550 |
| 21 | 0.10447 | 0.08422 |
| Bust | 0.22058 | 0.20004 |
| Return | | 0.993117 |

| Regular BJ | Suspense 21 |
|---|---|
| Player Exp. Profit -0.0040 | Player Exp. Profit -0.00750 |
| Standard Deviation 1.135003 | Standard Deviation 1.247945 |
| Expected Wager 1.1321 | Expected Wager 1.095000 |
| Player Wins 0.4346 | Player Wins 0.380727 |
| Player Loses 0.4798 | Player Loses 0.439526 |
| Player Pushes 0.0856 | Player Pushes 0.159602 |
| Player Cards 2.7119 | Player Cards 1.6043 |
| Player BJ win 0.0454 | Player BJ win 0.0202 |

| Decks | Cut Cards | Playable | Wager |
|---|---|---|---|
| 6 | 78 | 234 | $5 |

| Expected Number of Rounds/Shoe | | |
|---|---|---|
| Players | Regular BJ | Suspense 21 |
| 3 | 28.76 | 48.62 |
| 4 | 21.57 | 36.46 |
| 5 | 17.26 | 29.17 |
| 6 | 14.38 | 24.31 |
| 7 | 12.33 | 20.84 |

| $ Won by House per Shoe | |
|---|---|
| Reg BJ | Suspense |
| Win / Shoe | Win / Shoe |
| $ 1.71 | $ 5.02 |

| Cards removed | z | PFavoribility | Odds |
|---|---|---|---|
| 52 | 1.3505 | 0.088435635 | 11.31 |
| 104 | 0.8717 | 0.19168002 | 5.22 |
| 156 | 0.6438 | 0.259842054 | 3.85 |
| 208 | 0.4987 | 0.308977868 | 3.24 |
| 226 | 0.4589 | 0.323138286 | 3.09 |

FIGURE 3H

Suspense 21

D6-RT-AC-MHA 1) 6 Decks of cards
2) Bet Tripling Allowed (1,3,9,27, etc.)
3) Raise bet anytime is allowed
4) Multiple hits allowed after raising bet

| Regular BlackJack Game | | |
|---|---|---|
| Totals | Dealer | Player |
| 4 | | 0.000274 |
| 5 | | 0.000571 |
| 6 | | 0.000845 |
| 7 | | 0.001142 |
| 8 | | 0.001416 |
| 9 | | 0.001713 |
| 10 | | 0.001987 |
| 11 | | 0.003167 |
| 12 | | 0.030802 |
| 13 | | 0.052658 |
| 14 | | 0.046907 |
| 15 | | 0.047534 |
| 16 | | 0.047534 |
| 17 | 0.145225 | 0.115280 |
| 18 | 0.139247 | 0.109544 |
| 19 | 0.133685 | 0.115720 |
| 20 | 0.179583 | 0.160582 |
| 21 | 0.120338 | 0.102194 |
| Bust | 0.281922 | 0.152956 |
| Return | | 0.9965 |

| Suspense 21 Game | | |
|---|---|---|
| Totals | Dealer | Player |
| 6 | | 0.00052 |
| 7 | | 0.00112 |
| 8 | | 0.00233 |
| 9 | | 0.00543 |
| 10 | | 0.00928 |
| 11 | 0.00306 | 0.01391 |
| 12 | 0.04464 | 0.04820 |
| 13 | 0.05178 | 0.05514 |
| 14 | 0.05685 | 0.06127 |
| 15 | 0.06173 | 0.06580 |
| 16 | 0.06620 | 0.07083 |
| 17 | 0.07033 | 0.07919 |
| 18 | 0.07396 | 0.08239 |
| 19 | 0.08653 | 0.08371 |
| 20 | 0.15987 | 0.13559 |
| 21 | 0.10447 | 0.08432 |
| Bust | 0.22058 | 0.20095 |
| Return | | 0.993730 |

| Regular BJ | Suspense 21 |
|---|---|
| Player Exp. Profit -0.0040 | Player Exp. Profit -0.00690 |
| Standard Deviation 1.135003 | Standard Deviation 1.360621 |
| Expected Wager 1.1321 | Expected Wager 1.099500 |
| Player Wins 0.4346 | Player Wins 0.380485 |
| Player Loses 0.4798 | Player Loses 0.439556 |
| Player Pushes 0.0856 | Player Pushes 0.159815 |
| Player Cards 2.7119 | Player Cards 1.6098 |
| Player BJ win 0.0454 | Player BJ win 0.0202 |

| Decks | Cut Cards | Playable | Wager |
|---|---|---|---|
| 6 | 78 | 234 | $5 |

| Expected Number of Rounds/Shoe | | |
|---|---|---|
| Players | Regular BJ | Suspense 21 |
| 3 | 28.76 | 48.45 |
| 4 | 21.57 | 36.34 |
| 5 | 17.26 | 29.07 |
| 6 | 14.38 | 24.23 |
| 7 | 12.33 | 20.77 |

| $ Won by House per Shoe | |
|---|---|
| Reg BJ | Suspense |
| Win / Shoe | Win / Shoe |
| $ 1.71 | $ 4.56 |

| Cards removed | z | PFavoribility | Odds |
|---|---|---|---|
| 52 | 1.2154 | 0.112097723 | 8.92 |
| 104 | 0.7733 | 0.219668139 | 4.55 |
| 156 | 0.5611 | 0.287372232 | 3.48 |
| 208 | 0.4250 | 0.335418587 | 2.98 |
| 226 | 0.3875 | 0.349194218 | 2.86 |

FIGURE 3I

METHOD OF PLAYING A TWENTY-ONE GAME USING UNKNOWN SHARED CARDS ("SUSPENSE 21")

PRIORITY CLAIM

This application is a non-provisional patent application of and which claims priority to and the benefit of U.S. Provisional Patent Application Ser. No. 60/445,769, filed Feb. 10, 2003, which is incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

FIELD OF INVENTION

In general, the present invention relates to a method of playing a Twenty-One game and, more particularly, to a variant in which the dealer and players use one or more shared cards that remain unknown until all player and/or dealer decisions are completed.

BACKGROUND OF THE INVENTION

Twenty-One is a game of chance in which a dealer and one or more players attempt to build hands with counts of twenty-one, or as close to twenty-one as possible without exceeding twenty-one.

Traditional Twenty-One

To play a traditional Twenty-One game, the player places an initial wager between the minimum and maximum amounts set by the gaming establishment. After placing a wager, the player and the dealer are dealt two initial cards. The player's cards are dealt face-up ("shown cards") or face-down ("hole cards"); the dealer's cards are dealt one face-up and the other face-down.

All cards are dealt from one or more standard deck of 52 cards comprised of four cards of 13 ranks: 2, 3, 4, 5, 6, 7, 8, 9, 10, Jack, Queen, King and Ace. The number-value cards (i.e. 2 through 10) each count at face value; Jack, Queen, and King cards each count as ten; and Ace cards count as one or eleven toward the total hand count.

Based upon the initial cards, a player may take any of the following actions: take one or more additional cards ("hit"), double the initial wager and take exactly one hit ("double-down"); divide a pair of same cards into two hands with separate wagers on each hand ("split pairs"); place a side bet that the dealer has blackjack when dealer shows an Ace ("insurance"); or, stop taking any additional cards ("stand").

After the first hit, the player may not double-down, split pairs, or buy insurance; a hit may only be followed by another hit or standing. After a double-down, the player may not double-down again, hit, split pairs or buy insurance; a double-down must be followed by standing. No decisions of any type may be made once the player has decided to stand or after the hand count exceeds twenty-one ("busts").

After all players have made their decisions or busted, the dealer's cards are revealed and played according to a pre-determined rule: the dealer must hit until the hand count equals or exceeds seventeen and must stand on all hand counts above seventeen. In dealer hands with an ace ("soft hands"), the rule may instruct the dealer to hit a two-card seventeen ("soft seventeen") or stand on a soft seventeen.

At the end of all player and dealer decisions, the dealer's hand count is compared to each player's hand count:

- If the player has a higher hand count than the dealer, without busting, the player wins;
- If the dealer has a higher hand count than the player, without busting, the player loses;
- If the player busts, the player loses regardless of the dealer's hand count;
- If the dealer busts and the player does not bust, the player wins; and
- If the player and dealer have the same hand count, no one wins or loses unless the hand count is twenty-one and one of the two hands is comprised of two cards. A two card twenty-one ("blackjack") beats any other hand count of twenty-one.

All winning blackjack hands are paid at 3:2 odds, such that the total wager is returned along with an additional amount equal to one-and-a-half times the total wager. A growing number of gaming establishments, however, reduce the winning blackjack award to 6:5 odds. All other winning non-blackjack hands are paid at 1:1 odds, such that the total wager is returned along with an additional amount equal to the total wager.

Variants Using Shared Cards

Variants of traditional Twenty-One provide the dealer and players with one or more cards common to dealer and player hands. Shared cards speed up the game by requiring fewer cards dealt since the dealer only needs to deal one card to each player instead of two cards. Shared card games allow players to wager on more hands and gaming establishments to generate more revenue.

Further, shared cards provide a communal point from which players make decisions and celebrate winning outcomes. Shared card games build communal energy around the game, attract more players to the game, keep players at the game, increase profits for gaming establishment, and develop player loyalty to the gaming establishment.

A first method using shared cards is disclosed in U.S. Pat. No. 5,320,356, filed on Aug. 23, 1993, and assigned on its face to Fast Action Games Tech., Inc., and hereinafter referred to as "Patent 356." Patent 356 teaches a Twenty-One game in which a shared card counts towards the hand count of both players and the dealer.

In a preferred embodiment of Patent 356, the game is played by dealing a face-up card to each of the players and the dealer, and then a face-down shared card. Players may make an insurance wager, if the dealer shows an ace, and/or place an additional "even money wager" on the outcome of the hand. Following these bets, the shared card is revealed and used to calculate the value of each player's hand and the dealer's hand. The players may hit, stand, double or split according to traditional Twenty-One rules. After all player decisions are made, the dealer's hand is played according the traditional Twenty-One rules.

A second method using shared cards is disclosed in U.S. Pat. No. 5,934,675, filed on Apr. 9, 1998, and assigned on its face to Las Vegas Single Hand 21, LLC, and hereinafter referred to as "Patent 675." Similar to Patent 356, Patent 675 teaches a Twenty-One game with shared cards used by players and the dealer in accordance with traditional Twenty-One rules.

In a preferred embodiment of Patent 675, the game is played by dealing a face-up card to each of the players and the dealer, and then a face-up shared card. The shared card is used to calculate the value of each player's hand and the dealer's hand. Each player's hand is hit until the hand count equals or exceeds twelve. The player may then decide to hit or stand, with all hits dealt to the individual player, according to traditional Twenty-One rules. After players have completed their decisions, the dealer's hand is also played according the traditional Twenty-One rules.

Variants of traditional Twenty-One using shared cards, such as the preferred embodiments of Patents 356 and 675 described above, use cards known to players and the dealer before requiring players or the dealer to make decisions ("known shared cards"). These known shared card variants employ traditional Twenty-One rules and strategy and thus suffer from the same drawbacks as the traditional game:

First, traditional Twenty-One and variants using known shared cards require complex strategies. Players make mistakes, lose money, grow frustrated, and seek out other games to play and other gaming establishments in which to wager.

Second, traditional Twenty-One and variants using known shared cards only allow the player to increase the wager once per hand and then only increase the wager up to double the initial amount. Wagering restrictions frustrate a player seeking to press an advantage over the dealer with multiple wager increases.

Third, traditional Twenty-One and variants using known shared cards only allow the player to take one hit after increasing a wager. Card restrictions frustrate a player seeking to improve a hand and protect an enhanced wager.

Thus, there exists a need for a variant of traditional Twenty-One to overcome these drawbacks and more fully exploit the potential of Twenty-One games. It is an object of the present invention to provide such a variant, with all of the advantages described in the sections below.

SUMMARY OF THE INVENTION

The present invention is a variant of Twenty-One in which the dealer and players use one or more shared cards that remain unknown until all player and/or dealer decisions are completed ("unknown shared cards").

To play a preferred embodiment of the present invention, a player places an initial wager and is dealt one card face-up. The dealer is also dealt one card face-up. An unknown shared card is then dealt face-down. If the dealer's face-up card is a "9" of any suit, a second shared card is dealt face-down.

Following the initial deal, the player may make one of three decisions: take one or more additional cards ("hit"), increase the wager up to twice the previous amount and hit ("raise-and-hit"), or stop taking any additional cards ("stand"). The player may hit or raise-and-hit any number of times provided that the player's hand count does not exceed twenty-one ("bust").

Once the player stands, the dealer plays according to a pre-determined rule: hit until the hand count equals or exceeds nine and stand on all hand counts above nine. In dealer hands with an ace, the dealer always values the Ace as eleven ("soft hands"). The dealer always stands with an Ace face-up and may not hit any soft hand.

At the end of all player and dealer decisions, the unknown shared card(s) is revealed by the dealer. Players and the dealer add the value of the shared card(s) to their hand count. Each player's hand count is then compared to the dealer's hand count to determine an outcome, as follows:

If the player has a higher hand count than the dealer, without busting, the player wins;

If the dealer has a higher hand count than the player, without busting, the player loses;

If the player busts, the player loses regardless of the dealer's hand count;

If the dealer busts and the player does not bust, the player wins; and

If the player and dealer have the same hand count, no one wins or loses unless the hand count is twenty-one and one of the two hands is comprised of two cards. A two card twenty-one ("blackjack") beats any other hand count of twenty-one.

Winning blackjack hands are paid at 3:2, such that the total wager is returned along with an additional amount equal to one and one-half times the total wager. All other winning hands are paid at 1:1, such that the total wager is returned along with an additional amount equal to the total wager.

By using unknown shared cards, the present invention overcomes the drawbacks of traditional Twenty-One and variants using known shared cards, as described in the section above.

First, the present invention uses much simpler strategy than traditional Twenty-One and variants using known shared cards. Second, the present invention allows the player to raise the wager multiple times, with each raise increasing the wager up to three times. And, third, the present invention allows the player to take an unlimited number of hits after increasing a wager.

In addition to overcoming the drawbacks of traditional Twenty-One and variants using shared cards, the present invention provides its own unique advantages inherent to using unknown shared cards:

First, unknown shared cards lead to fewer player busts. Since basic strategy mandates standing on any hand showing 11 or more, players never bust prior to seeing the shared card and bust less frequently after seeing the shared card.

Second, unknown shared cards keep players involved throughout every hand. Since players do not bust before seeing the shared card, every player is involved in every hand until the shared card is revealed.

Third, unknown shared cards increase suspense and excitement. Since players are kept in suspense until the final card, players stay focused and excited about the potential outcome of every game until the shared card is revealed.

BRIEF DESCRIPTION OF THE DRAWINGS

FIG. 2 shows a player strategy card for a preferred embodiment of the present invention that indicates the mathematically correct action—hit, raise-and-hit, or stand—for all hand counts.

FIGS. 3*a–i* compare nine preferred embodiments of the present invention, using different wagering and card-play options, against traditional Twenty-One.

DETAILED DESCRIPTION OF THE PREFERRED EMBODIMENTS

Figure 1:
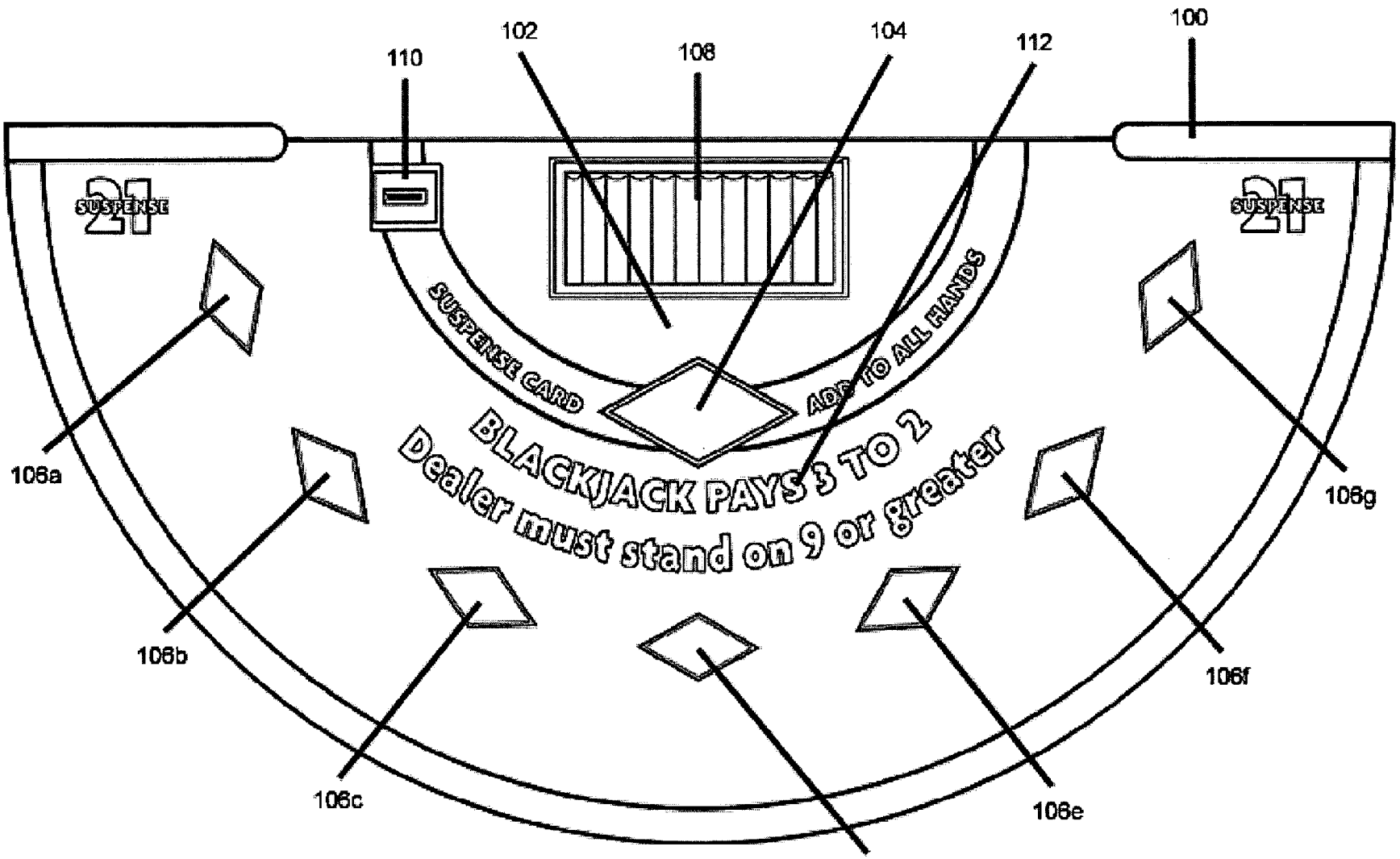
FIG. 1 shows an aerial view of a table layout for a preferred embodiment of the present invention, with seven player positions, a dealer position, a shared card(s) area, a rules area, a chip rack, and a deposit slot to a deposit box.

A preferred embodiment of the present invention—"Suspense 21"—is a variant of traditional Twenty-One in which the dealer and players attempt to build a hand with a value of twenty-one, or as close to twenty-one as possible without exceeding twenty-one, using cards that are known to players and the dealer as they are dealt and shared cards that remain unknown until all player and/or dealer decisions are completed.

Playing Suspense 21 on a Table Layout

FIG. 1 shows a preferred Suspense 21 table layout 100, including dealer position 102, shared card(s) position 104 and seven player positions 106*a*–106*g*. In addition, the layout includes a chip rack 108, tip slot 110, and various printed instructions and logos 112. In alternative embodiments, a layout may include any number of dealer, player and/or shared card positions.

Suspense 21 is played with six standard decks of playing cards stacked to the left of chip rack 108, with each deck containing 52 cards comprised of four cards of thirteen ranks: 2, 3, 4, 5, 6, 7, 8, 9, 10, Jack, Queen, King and Ace. In alternative embodiments, the game may use any number of decks of cards and/or decks of cards with any number of ranks, types of ranks, or cards per rank.

Of these cards, the number-value cards (i.e. 2 through 10) each count at face value; Jack, Queen, and King cards each count as ten; and Ace cards count as one or eleven towards the total hand count. In alternative embodiments, each card may be assigned any value or values, according to any pre-determined value schedule.

Players wager an initial amount between the minimum and maximum amounts set by the gaming establishment at 106*a*–106*g*. All additional wagers are placed directly behind the initial wager at 106*a*–106*g*. In alternative embodiments, the gaming establishment may provide any location for wagers, separate locations for different wagers, and set any minimum and/or maximum wager amounts.

An initial card is dealt face-up to each player at 106*a*–106*g* and the dealer is also dealt an initial card face-up at 102. In alternative embodiments, the initial player and dealer cards may be dealt face-down, the initial player cards may be dealt face-up and the dealer cards face-down, and/or the initial player cards may be dealt face-down and the dealer cards face-up.

A shared card is then dealt facedown at 104. In alternative embodiments, more than one initial shared card may be dealt at 104. In embodiments with one initial shared card, the card is always dealt face-down. In embodiments with two or more initial shared cards, at least one card must be dealt face-down.

If the dealer's face-up card is a "9" of any suit, a second shared card is dealt facedown at 104. In alternative embodiments, a second common is dealt if the dealer's face-up card or cards equal any pre-determined value. In further embodiments, additional shared cards may be dealt, at any time, based upon any value of the player's cards and/or wagers.

If the dealer's face-up card is an Ace of any suit, the dealer does not offer players an insurance bet. In alternative embodiments, the dealer may offer insurance bets when showing an Ace. If the dealer's face-up card is an Ace, King, Queen, Jack, or "10," the dealer does not "peek" at the unknown shared card to check for blackjack. In alternative embodiments, the dealer may check for blackjack.

After the initial deal, each player may take one of three actions following the initial deal: hit at 106*a*–106*g*, raise and hit at 106*a*–106*g*, or stand with the cards and wager at 106*a*–106*g*. The player may not split pairs, buy insurance, or take any other actions. In alternative embodiments, the player may split pairs, buy insurance, and/or take other actions.

A player may hit any number of times at 106*a*–106*g* until standing or busting. In alternative embodiments, the player may be limited to a fixed number of hits per hand and/or a fixed number of hits after raising the wager.

A player may raise and hit at 106*a*–106*g* any number of times until standing or busting. The player may raise the wager up to three times the amount at 106*a*–106*g* and then must take a hit at 106*a*–106*g*. All additional wagers are placed to the side of the initial wager at 106*a*–106*g*. In alternative embodiments, the player may raise the wager by any multiple and/or take any number of hits with each raise.

A player may stand with the card(s) and wager at 106*a*–106*g* at any point prior to busting. Once the player has decided to stand, no further actions may be taken. In alternative embodiments, the player may stand and then take additional actions after other player actions and/or dealer actions.

During a player's turn, any number of hits at 106*a*–106*g* may be combined with raise and hits at 106*a*–106*g*, in any order, prior to standing or busting. Hits at 106*a*–106*g* may be followed by raise and hits at 106*a*–106*g*; raise and hits at 106*a*–106*g* may be followed by hits at 106*a*–106*g*. In alternative embodiments, the player may have a limited number of actions and/or have to perform actions in a pre-determined sequence.

The player in the rightmost player position at 106*g* has the first turn. Once the player at 106*g* finishes, the player to the left at player position 106*f* acts next. All empty player positions are skipped, if any. In alternative embodiments, any position may start first and play may continue in any random or pre-determined order of subsequent positions.

Once players act on their hands, the dealer must act according to a pre-determined rule: hit at 102 until the dealer's hand count equals or exceeds nine and then stand with the cards at 102. The dealer always stands with an Ace face-up or any other soft hand at 102. In alternative embodiments, the dealer may hit until the hand count equals or exceeds any value and/or the dealer's hand contains any number of cards.

At the end of all player and dealer actions, the dealer reveals the shared card(s) at 104. Players and the dealer add the value of the shared card(s) at 104 to their hand count. Each player's hand count is then compared to the dealer's hand count to determine an outcome. In alternative embodiments, players may make reduce and/or enhance their wagers at 106*a*–106*g* before or after each shared card is revealed.

The player wins if the player has a higher hand count than the dealer without busting, or the dealer busts and the player does not bust. Winning non-blackjack hands are paid at 1:1 odds; winning blackjack hands are paid at 3:2 odds. In alternative embodiments, the player may collect winning hand payouts at any odds on the initial and/or subsequent wagers.

The player loses if the dealer has a higher hand count than the player without busting, or the player busts, even if the dealer also busts. All wagers are on losing hands are lost. In alternative embodiments, player and dealer busts may result in no win or loss and the return of some or all of the player's wager ("push").

If the player and dealer have the same hand count, the player and dealer push unless the hand count is twenty-one and one of the two hands is blackjack. Blackjack beats any other hand count of twenty-one. If the player and dealer both have blackjack, the player and dealer push. In alternative embodiments, the player may win or lose with the same hand count as the dealer.

All hand counts, including player and dealer hands, are determined by the dealer. Based upon the hand counts, the dealer distributes awards to players at 106*a*–106*g* for winning hands or collects wagers from players at 106*a*–106*g* for losing hands. In alternative embodiments, a third party or electronic device may determine winning hands and distribute awards to any locations on a layout.

Following the completion of each hand, players collect awards at 106*a*–106*g*, if any, and place another wager at 106*a*–106*g* or stop playing the game. No additional wagers may be placed following the completion of a hand. In alternative embodiments, the player may participate in bonus events, with or without additional wagering, following the completion of a hand.

FIG. 1 shows a Suspense 21 table layout 100 designed for use as a playing surface on a gaming table. The Suspense 21 layout 100 may replace the traditional Twenty-One layout commonly used in casinos. In alternative embodiments, the present invention may be played in different formats and media, including game tables of any size, game boards or electronic displays or devices.

Playing Suspense 21 with a Strategy Card

FIG. 2 shows a preferred strategy card with actions based upon mathematical analysis of a Suspense 21 game using six standard decks of cards; unlimited number of hits; unlimited number of raise-and-hits; raise up to double the previous amount; blackjack beats all other twenty-one hand counts; dealer and player blackjacks are a push; and winning blackjack hands pay 3:2 odds.

Actions listed on the strategy card in FIG. 2 are designed to maximize the player's profits during play of the Suspense 21 game, with a net result of −1.8% player profit on an average bet of 1.0899 credits. Any actions taken that do not correspond with the strategy card will result in lower net player profit over the long run.

The strategy card in FIG. 2 lists actions to be taken with any possible hand count, including soft hands. The actions include hit (H), raise-and-hit (R), and stand (S); no other actions are permitted. For example, the strategy card indicates that a player should stand with a hand count of 7 opposite a dealer 4 and raise-and-hit with a hand count of 3 opposite a dealer's 10.

All Suspense 21 strategies, including the strategy card in FIG. 2, indicate that the player should always stand with any hand count of 11 or more that does not include an Ace. By following this simple strategy, the player never busts before seeing the shared card(s) and stays involved in the game until the shared card is revealed. Further, the player busts less often after seeing the shared card(s).

Comparing Suspense 21 with Traditional Twenty-One

FIGS. 3*a*–*f* compare the results of nine Suspense 21 games using varying wagering and game-play options, with traditional Twenty-One. Each of the nine comparisons assumes perfect play, using profit maximizing strategy, of traditional Twenty-One and Suspense 21.

FIG. 3*a* compares traditional Twenty-One with a Suspense 21 game using six standard decks of cards; raise up to one time the previous amount; raise-and-hit after initial card only; and only one hit after a raise. These wagering and game-play options most closely resemble traditional Twenty-One and produce the following differences:

5.76% fewer player wins;

4.01% fewer player losses;

7.39% more player-dealer pushes;

1.1188 fewer cards dealt per hand;

1.62% higher expected profit per hand for the gaming establishment; and $12.62 greater win per 234 cards played ("shoe") with an average wager of $5 per player hand.

FIG. 3*i* compares traditional Twenty-One with a Suspense 21 game using six standard decks of cards; raise up to three times the previous amount; unlimited raises-and-hits; and unlimited hits after a raise. These wagering and game-play options least closely resemble traditional Twenty-One and produce the following differences:

5.41% fewer player wins;

4.02% fewer player losses;

7.42% more player-dealer pushes;

1.102 fewer cards dealt per hand;

0.29% higher expected profit per hand for the gaming establishment; and $4.56 greater win per shoe with an average wager of $5 per player hand.

The remaining Suspense 21 games, as represented by FIGS. 3*b* through 3*h*, fall within the range of values shown in FIG. 3*a* and 3*i*. Each of the FIGS. 3*b* through 3*h* modify one of the wagering and/or game-play options to measure the result of such a modification. For example, FIG. 3*b* modifies FIG. 3*a* by replacing the one time restriction on hits after a raise with an unlimited number of hits after a raise.

All of the FIGS. 3*a* through 3*i* show that Suspense 21 games provide numerous advantages to the gaming establishment, including fewer cards dealt per hand, more hands dealt per shoe, higher expected profit per hand, and, therefore, increased profits per shoe. Thus, the mathematical analysis demonstrates how unknown shared cards provide the gaming establishment with a faster and more profitable game.

At the same time, FIGS. 3*a* through 3*i* show that Suspense 21 games provide players with the advantages of faster action, more wagers, less restrictions on the number and amount of wagers, more control over hits after increasing a wager, and the excitement and suspense of staying involved in each and every hand until the final unknown shared card is revealed.

PREAMBLE TO THE CLAIMS

The many features and advantages of the present invention are apparent from the descriptions, figures, and flowcharts of the preferred and alternative embodiments described above. The present invention, however, is not limited to these embodiments, as the invention is capable of other embodiments and of being practiced and carried out in various ways. For example, features from one embodiment may be combined with features of another to yield a new embodiment. Additionally, features mentioned in any embodiment may be interchanged with similar features not mentioned that perform the same or similar functions. And, finally, the phraseology and terminology used to explain the embodiments are only descriptive and should not be regarded as limiting. The claims, therefore, seek to cover all features and advantages that fall within the spirit and scope of the present invention.

We claim:

1. A method of playing a modified twenty-one game between at least one player and a dealer using one or more decks of cards and a table layout having a playing surface with a dealer position, a plurality of player positions, and a shared card position, comprising the steps of:

(a) each player placing an initial wager to participate in the game;

(b) dealing one or more cards to each player at the player's position;

(c) dealing one or more cards to the dealer at the dealer's position;

(d) dealing one or more shared cards to the shared card position, wherein the value and the suit of the shared card(s) are unknown to the players and the dealer;

(e) dealing additional cards to players electing to receive more cards;

(f) allowing players to adjust the wager prior to receiving additional cards;

(g) dealing additional cards to the dealer following a fixed set of rules;

(h) revealing the value and the suit of the shared cards after all player and dealer decisions are completed, wherein the value and the suit of the shared card(s) remain unknown until this revealing step;

(i) calculating the hand count of each player hand using the card values dealt to the player and the total value of the shared cards;

(j) calculating the hand count of the dealer hand using the card values dealt to the dealer and the total value of the shared cards;

(k) comparing the hand count of each player's hand to the hand count of the dealer's hand to determine whether each player beats the dealer, loses to the dealer or ties with the dealer;

(l) issuing awards to each player beating the dealer, according to an award schedule.

2. A method of claim 1 in which the range of minimum and maximum initial wagers is established by the gaming establishment.

3. A method of claim 1 in which one initial card is dealt to each player.

4. A method of claim 1 in which any initial cards dealt to a player are face-up.

5. A method of claim 1 in which any initial cards dealt to a player are face-down.

6. A method of claim 1 in which some of the initial cards dealt to a player are face-up and some are face-down.

7. A method of claim 1 in which an initial card is dealt to a player and, if the dealer's card matches any pre-determined cards or values, a second card is dealt.

8. A method of claim 1 in which an initial card is dealt to a player and, if the dealer's card is a "9" of any suit, a second card is dealt.

9. A method of claim 1 in which one card is dealt to the dealer.

10. A method of claim 1 in which any initial cards dealt to the dealer are face-up.

11. A method of claim 1 in which any initial cards dealt to the dealer are face-down.

12. A method of claim 1 in which some of the initial cards dealt to the dealer are face-up and some are face-down.

13. A method of claim 1 in which an initial card is dealt to the dealer and, if the dealer's card matches any pre-determined cards or values, a second card is dealt.

14. A method of claim 1 in which a first card is dealt to the dealer and, if the dealer's card is a "9" of any suit, a second card is dealt.

15. A method of claim 1 in which a first initial unknown shared card is dealt and, if the dealer's card matches any pre-determined cards or values, a second unknown shared card is dealt.

16. A method of claim 1 in which a first initial unknown shared card is dealt and, if the dealer's card is a "9" of any suit, a second unknown shared card is dealt.

17. A method of claim 1 in which all shared cards are unknown and dealt face-down.

18. A method of claim 1 in which at least one of the shared cards is unknown and dealt face-down.

19. A method of claim 1 in which a player may elect to receive additional cards until the hand count equals or exceed a pre-determined maximum value.

20. A method of claim 1 in which a player may elect to receive additional cards until the hand count equals or exceed a value of 21.

21. A method of claim 1 in which a player may elect to receive additional cards regardless of any adjustments to the wager.

22. A method of claim 1 in which a player may only receive a fixed number of additional cards following an adjustment to the wager.

23. A method of claim 1 in which a player may only receive one additional card following an adjustment to the wager.

24. A method of claim 1 in which a player may adjust the wager by electing to receive at least one additional card.

25. A method of claim 1 in which a player may adjust the wager up to double the amount previously wagered by electing to receive at least one additional card.

26. A method of claim 1 in which a player may adjust the wager up to triple the amount previously wagered by electing to receive at least one additional card.

27. A method of claim 1 in which a player may adjust the wager by electing to receive at least one additional card until the hand count equals or exceed a pre-determined maximum value.

28. A method of claim 1 in which a player may adjust the wager by electing to receive at least one additional card until the hand count equals or exceed a value of 21.

29. A method of claim 1 in which a player may adjust the wager without electing to receive additional cards.

30. A method of claim 1 in which the dealer receives additional cards until the hand count equals or exceed a pre-determined maximum value.

31. A method of claim 1 in which the dealer receives additional cards until the hand count equals or exceed a value of 9.

32. A method of claim 1 in which cards are dealt from one or more standard deck of 52 cards comprised of four cards of 13 ranks: 2, 3, 4, 5, 6, 7, 8, 9, 10, Jack, Queen, King and Ace, with a player's hand count calculated by:

(a) counting 2 through 10 cards at face value;

(b) counting Jack, Queen, and King cards as ten; and (c) counting Ace cards as one or eleven.

33. A method of claim 1 in which cards are dealt from one or more standard deck of 52 cards comprised of four cards of 13 ranks: 2, 3, 4, 5, 6, 7, 8, 9, 10, Jack, Queen, King and Ace, with a dealer's hand count calculated by:

(a) counting 2 through 10 cards at face value;

(b) counting Jack, Queen, and King cards as ten; and (c) counting Ace cards as one or eleven.

34. A method of claim 1 in which cards are dealt from one or more standard deck of 52 cards comprised of four cards of 13 ranks: 2, 3, 4, 5, 6, 7, 8, 9, 10, Jack, Queen, King and Ace, with a dealer's hand count calculated by:

(a) counting 2 through 10 cards at face value;

(b) counting Jack, Queen, and King cards as ten; and (c) counting Ace cards as eleven if possible to do so without exceeding a hand count of 21, or otherwise counting the Ace as one.

35. A method of claims 1 in which player and dealer cards are dealt from the same one or more decks of cards.

36. A method of claims 1 in which player and dealer cards are dealt from different decks of cards.

37. A method of claim 1 in which the comparison of a player's hand count with the dealer's hand count results in the following outcomes:

(a) If a player has a higher hand count than the dealer without busting, the player beats the dealer;

(b) If the dealer has a higher hand count than a player without busting, the player loses to the dealer;

(c) If a player busts, the player loses to the dealer regardless of the dealer's hand count;

(d) If the dealer busts and a player does not bust, the player beats the dealer; and (e) If a player and dealer have the same hand count, the player and dealer tie unless the hand count is twenty-one and one of the two hands is comprised of two cards in which case a two card twenty-one beats any other hand count of twenty-one.

38. A method of claim 1 in which the comparison of a player's hand count with the dealer's hand count results in the following outcomes:

(a) If a player has a higher hand count than the dealer without busting, the player beats the dealer;

(b) If the dealer has a higher hand count than a player without busting, the player loses to the dealer;

(c) If a player busts, the player loses to the dealer regardless of the dealer's hand count;

(d) If the dealer busts and a player does not bust, the player beats the dealer; and (e) If a player and dealer have the same hand count, the player loses to the dealer.

39. A method of claim 1 in which awards issue for all winning player hands in accordance with the following pay schedule:

(a) Two cards with a hand count of twenty-one pays three-to-two odds; and (b) All other hands pay one-to-one odds.

40. A method of claim 1 in which awards issue for all player hands that beat the dealer hand, in accordance with the following pay schedule:

(a) Two cards with a hand count of twenty-one pays six-to-five odds; and (b) All other hands pay one-to-one odds;

(c) A method of claim 1 in which awards issue for all player hands that beat the dealer hand such that the odds paid on the initial wager are the same as the odds paid for any subsequent wagers.

41. A method of claim 1 in which awards issue for all player hands that beat the dealer hand, in accordance with the following pay schedule:

(a) Two cards with a hand count of twenty-one pays six-to-five odds; and (b) All other hands pay one-to-one odds.

42. A method of claim 1 in which awards issue for all player hands that beat the dealer hand such that the odds paid on the initial wager are different than the odds paid for any subsequent wagers.

43. A method of playing a modified twenty-one game between at least one player and a dealer using one or more decks of cards and a table layout having a playing surface with a dealer position, a plurality of player positions, and a shared card position, comprising the steps of:

(a) each player placing an initial wager between the maximum and minimum wager levels set by the gaming establishment to participate in the game;

(b) dealing one card face-up to each player at the player's position;

(c) dealing one card face-up to the dealer at the dealer's position;

(d) dealing one shared card face-down to the shared card position and, if the dealer's card is a "9" of any suit, dealing a second shared card face-down to the shared card position, wherein the value and the suit of the shared card(s) are unknown to the players and the dealer;

(e) dealing any number of additional cards to players electing to receive more cards, regardless of any adjustments to the wager, until a player's hand count equals or exceeds a value of 21;

(f) allowing players to adjust the wager up to triple the amount wagered prior to receiving an additional card until the player's hand count equals or exceeds a value of 21;

(g) dealing additional cards to the dealer until the dealer's hand count equals or exceeds a value of 9;

(h) revealing the value and the suit of the shared cards after all player and dealer decisions are completed, wherein the value and the suit of the shared card(s) remain unknown until this revealing step;

(i) calculating the hand count of each player's hand using the card values dealt to the player and the total value of the shared cards, with all cards dealt from one or more standard deck of 52 cards comprised of four cards of 13 ranks: 2, 3, 4, 5, 6, 7, 8, 9, 10, Jack, Queen, King and Ace, such that:

i. 2 through 10 cards count at face value;

ii. Jack, Queen, and King cards count as ten; and iii. Ace cards count as one or eleven;

(j) calculating the hand count of the dealer's hand using the card values dealt to the player and the total value of the shared cards, with all cards dealt from the same one or more standard deck of 52 cards used by the players and comprised of four cards of 13 ranks: 2, 3, 4, 5, 6, 7, 8, 9, 10, Jack, Queen, King and Ace, such that:

i. 2 through 10 cards count at face value;

ii. Jack, Queen, and King cards count as ten; and vi. Ace cards count as eleven if possible to do so without exceeding a hand count of 21, or otherwise Ace cards count as one;

(k) comparing the hand count of each player's hand to the hand count of the dealer's hand to determine one of the following outcomes:

i. If a player has a higher hand count than the dealer without busting, the player beats the dealer;

ii. If the dealer has a higher hand count than a player without busting, the player loses to the dealer;

iv. If a player busts, the player loses to the dealer regardless of the dealer's hand count;

iv. If the dealer busts and a player does not bust, the player beats the dealer; and v. If a player and dealer have the same hand count, the player and dealer tie unless the hand count is twenty-one and one of the two hands is comprised of two cards in which case a two card twenty-one beats any other hand count of twenty-one;

(l) issuing awards to each player beating the dealer, in accordance with the following pay schedule:

i. Two cards with a hand count of twenty-one pays three-to-two odds on the entire wager; and ii. All other hands pay one-to-one odds on the entire wager.

* * * * *